US011060412B2

(12) United States Patent
Gamm et al.

(10) Patent No.: US 11,060,412 B2
(45) Date of Patent: Jul. 13, 2021

(54) METHOD FOR CONTROLLING A GAP MINIMIZATION OF A GAS TURBINE

(71) Applicant: Siemens Aktiengesellschaft, Munich (DE)

(72) Inventors: Hans-Georg Gamm, Dinslaken (DE); Marcus Hüning, Mülheim an der Ruhr (DE); Uwe Kahlstorf, Mülheim a.d. Ruhr (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/976,257

(22) PCT Filed: Mar. 11, 2019

(86) PCT No.: PCT/EP2019/055994

§ 371 (c)(1),
(2) Date: Aug. 27, 2020

(87) PCT Pub. No.: WO2019/175091

PCT Pub. Date: Sep. 19, 2019

(65) Prior Publication Data

US 2021/0003027 A1 Jan. 7, 2021

(30) Foreign Application Priority Data

Mar. 14, 2018 (DE) ..... 10 2018 203 896.1
Jun. 11, 2018 (EP) ..... 18176962

(51) Int. Cl.
*F01D 11/14* (2006.01)
*F01D 25/14* (2006.01)

(52) U.S. Cl.
CPC ..... *F01D 11/14* (2013.01); *F01D 25/14* (2013.01); *F05D 2270/305* (2013.01); *F05D 2270/80* (2013.01)

(58) Field of Classification Search
CPC ..... F01D 11/14; F01D 25/14; F01D 11/20; F01D 11/22; F05D 2270/305;
(Continued)

(56) References Cited

U.S. PATENT DOCUMENTS 4,069,662 A * 1/1978 Redinger, Jr. ..... F01D 11/24 60/226.1
4,230,436 A * 10/1980 Davison ..... F01D 11/24 415/1

(Continued)

FOREIGN PATENT DOCUMENTS

EP 2236771 A2 10/2010
EP 2549065 A1 1/2013

(Continued)

OTHER PUBLICATIONS

PCT International Search Report and Written Opinion of International Searching Authority dated Jul. 2, 2019 corresponding to PCT International Application No. PCT/EP2019/055994 filed Mar. 11, 2019.

*Primary Examiner* — Woody A Lee, Jr.
*Assistant Examiner* — Eric A Lange

(57) ABSTRACT

A method for controlling a gap minimization for an adjustable gap between a rotor and a housing of a gas turbine carried out on the basis of a correlation extracted from simulation data. If the actual value ($P_I$) lies below the lower threshold ($P_U$), the gap minimization is deactivated, whereas if the actual value lies above the upper threshold ($P_O$), the gap minimization is activated. The gap minimization is activated between the thresholds ($P_U$, $P_O$) if the actual value lies above the threshold ($P_G$) but is deactivated if the actual value ($P_I$) lies below the threshold ($P_G$).

13 Claims, 1 Drawing Sheet

(58) Field of Classification Search
CPC ..... F05D 2270/80; F05D 2270/335; F05D 2270/64; F05D 2270/506; F02C 9/00; G05B 2219/32343
See application file for complete search history.

(56) References Cited

U.S. PATENT DOCUMENTS

| | | | | |
|---|---|---|---|---|
| 8,296,037 | B2 * | 10/2012 | Plunkett | F01D 11/24 701/100 |
| 8,342,798 | B2 * | 1/2013 | Floyd, II | F01D 11/24 415/116 |
| 2008/0267769 | A1 * | 10/2008 | Schwarz | F01D 11/24 415/148 |
| 2009/0003991 | A1 | 1/2009 | Andarawis et al. | |
| 2017/0292399 | A1 * | 10/2017 | Philbrick | B64D 27/10 |

FOREIGN PATENT DOCUMENTS

| | | | |
|---|---|---|---|
| EP | 2843198 | A1 | 3/2015 |
| WO | 2014016153 | A1 | 1/2014 |
| WO | 2015128193 | A1 | 9/2015 |

* cited by examiner

METHOD FOR CONTROLLING A GAP MINIMIZATION OF A GAS TURBINE

CROSS REFERENCE TO RELATED APPLICATIONS

This application is the US National Stage of International Application No. PCT/EP2019/055994 filed 11 Mar. 2019, and claims the benefit thereof. The International Application claims the benefit of European Application No. EP18176962 filed 11 Jun. 2018 and German Application No. DE 10 2018 203 896.1 filed 14 Mar. 2018. All of the applications are incorporated by reference herein in their entirety.

FIELD OF INVENTION

The invention relates to a method for controlling a gap minimization of an adjustable gap between a rotor and a housing of a gas turbine, wherein the gas turbine comprises a gap-adjusting device, in particular a hydraulic gap-adjusting device. The invention relates further to a control device for carrying out the method and to a gas turbine having such a control device.

BACKGROUND OF INVENTION

In order to permit maximum gas turbine efficiency, it is of vital importance to keep the gaps between the rotating and the static components as small as possible during operation. In the case of a conical turbine flow channel, one possible method of achieving this is to shift the rotor axially, for example by means of a hydraulic system, in steady-state high-load operation once transient phases in which the gaps at the blade tips narrow to the maximum extent have been passed through. If the rotor is shifted against the direction of flow, then the gaps reduce.

EP 2 843 198 A1 discloses a method and a device for controlling a rotor gap (tip clearance) of a gas turbine mechanism of an aircraft. Steps of the method include measuring at least one engine parameter; determining the engine power demand from the at least one engine parameter; and calculating the rotor gap given the determined engine power demand. The device for controlling the rotor gap is controlled in order to increase or reduce the rotor tip clearance based on the difference between the calculated clearance and a predefined target clearance.

EP 2 549 065 A1 likewise describes a system for operating a turbine comprising a rotating component and a non-rotating component which is separated from the rotating component by a gap. A first actuator is connected to the non-rotating component, and the first actuator comprises a shape-memory alloy. A method for operating the turbine includes sensing a parameter which reflects the gap between the non-rotating component and the rotating component, and generating a parameter signal which reflects the gap. The method further comprises generating a control signal for at least one actuator based on the parameter signal and moving at least a portion of the non-rotating component relative to the rotating component in order to change the gap.

From WO 2014/016153 A1 there is known a method for minimizing an adjustable gap between a rotor blade and a housing of a turbine. By shifting the rotor and the housing relative to one another, the gap between the rotor and the housing is to be minimized in a simple manner. For this purpose, an output signal of a structure-borne-noise monitoring system associated with the rotor and/or the housing is used as a measure of the size of the gap and thus for establishing a minimal gap.

A further method for partial-load operation of a gas turbine with active hydraulic gap adjustment is known, for example, from WO 2015/128193 A1.

In order to produce a marketable product, the decision about the reached position of the rotor must be controlled or regulated automatically. Since it is technically difficult or very expensive to permanently measure the operating gaps, a different procedure is necessary. A HCO (hydraulic clearance optimization) logic controller is here required in the controller of the gas turbine, which logic controller, on the basis of measurable values, specifies how the gap optimization is to be performed.

SUMMARY OF INVENTION

The object underlying the invention is to propose an improved HCO logic controller which permits optimal utilization of the gap adjustment during operation of the gas turbine in particular in the case of a load change.

The object is achieved according to the invention by a method for controlling a gap minimization of an adjustable gap between a rotor and a housing of a gas turbine, wherein the gas turbine comprises a gap-adjusting device, in particular a hydraulic gap-adjusting device, comprising the following steps: —with the aid of a simulation program, the operation of the gas turbine with different parameter settings is modeled and a simulation data set is prepared which contains the dependence of the gap size on an operating parameter, —on the basis of the simulation data set, a lower threshold and an upper threshold for the operating parameter are specified, —furthermore, for a transition region between the lower threshold and the upper threshold, a correlation between the operating parameter and a maximum value of the operating parameter is extracted from the simulation data set, —during operation of the gas turbine, an actual value of the operating parameter is continuously determined and compared with the lower threshold and the upper threshold, —and the maximum value of the actual value is determined over a specified time period, wherein in the comparison of the actual value with the lower threshold and the upper threshold, if the actual value: —lies below the lower threshold, the gap minimization is deactivated, —lies above the upper threshold, the gap minimization is activated, —lies in the transition region, a limit value for the operating parameter is determined with the aid of the maximum value from the specified time period using the correlation, and the gap minimization is activated if the actual value lies above the limit value and deactivated if the actual value lies below the limit value.

The object is further achieved according to the invention by a control device for carrying out the method, comprising a gap-adjusting device, in particular a hydraulic gap-adjusting device, and means for determining the actual value of the operating parameter. Depending on the operating parameter, the means for determining the actual value of the operating parameter can be sensors for a direct measurement or alternatively a different value correlated with the operating parameter can be measured directly and the operating parameter can be determined indirectly on the basis thereof by computation.

Finally, the object is achieved according to the invention by a gas turbine having such a control device.

The advantages and embodiments described hereinbelow in relation to the method can be applied analogously to the control device and the gas turbine.

Gap minimization is here understood as meaning an axial shift of the rotor of the gas turbine against the direction of flow, which shift is carried out with the aid in particular of the hydraulic means for adjusting the gap between the rotor and the housing. The term HCO equates to the term gap minimization in the further text. The gap minimization or the HCO function can thereby be activated (the rotor is shifted towards the housing) or deactivated.

"Is activated" or "is deactivated" is not to be understood solely as meaning the activation or deactivation of the HCO but, in the case where the gap minimization is already active, "be activated" equates to "remain activated". The same applies to a gap minimization that is already deactivated, in which case "be deactivated" also means "remain deactivated".

The invention is based on the consideration of providing a novel HCO logic controller which especially is simple and robust but can minimize the risks in the operating phases in which gap optimization is activated. For this purpose, numerous studies of transient maneuvers have been carried out by means of computer simulation, which form the basis of the improved HCO logic controller.

For optimized gap adjustment, an operating parameter is used with the aid of which the operating state of the gas turbine is detected. There can be used as the operating parameter, for example, the power of the gas turbine, a normalized relative power, temperatures or pressures along the main gas channel or also temperature and pressure conditions. The operating parameter is so chosen that it reacts to a load change.

The computer simulation by means of the simulation program takes place in particular outside operation, for example in the development stage of the gas turbine. Simulation program is understood as meaning a so-called digital twin of the gas turbine. The simulation program or simulation model allows a more accurate overview of the status of the turbine with very different parameter settings. Accordingly, operating parameters better adapted for the operational scenario can be determined in order to operate the gas turbine optimally. In the specific case, the behavior of the gas turbine is studied in relation to the gap between the rotor and the housing during the ongoing changes of the operating parameter.

The simulation data set generated by the simulation program then serves to choose the upper threshold and the lower threshold in such a manner that optimal use of the HCO is possible, in which the HCO is activated for as long as possible with acceptable losses of the gaps. The important feature for the evaluation of the simulations is that the narrowest gap of the various maneuvers should be as equal as possible in order to ensure that a maneuver does not "destroy" the gap.

A finding from analyses carried out hitherto is that it is large load reductions in particular which lead to a transient gap reduction and which must accordingly be accompanied by a HCO deactivation. The maximum value of the operating parameter from the time before a sudden load variation must accordingly be taken into consideration, since the maximum value of the operating parameter shifts the limit for HCO activation. For this reason, a correlation between the evolution of the maximum value of the operating parameter compared to the evolution of the operating parameter is extracted from the simulation data set. The result of this analysis can be outputted, for example, as a function which can exhibit inter alia a linear, convex or concave dependence.

During operation of the gas turbine, the actual value of the operating parameter is detected continuously, wherein "continuously" includes both the case of a continuous, uninterrupted, direct measurement or calculation from measured data and the case of a direct measurement or calculation from measured data at short time intervals. The currently detected actual value is compared with the lower and the upper threshold, wherein the course of the actual value is divided into at least three operating regimes or regions: a lower region, a middle transition region and an upper region.

In addition, the maximum value of the actual value is detected over a time period in the immediate past. On the basis of the maximum value, a limit value is determined with the aid of the correlation from the simulation results, which limit value is then used if the actual value in the transition region lies between the lower and the upper threshold.

The gas turbine is operated in the lower load region mostly for only a very short time, if at all, owing to the pollutant emissions and the low efficiency. Accordingly, the efficiency in this load range contributes only very negligibly to the overall efficiency over the operating cycle of the machine. In this respect, there is no requirement for activation of the HCO in this difficult environment. For this reason, the lower threshold for the operating parameter is defined. In the lower region, below the lower threshold, the gap minimization is therefore deactivated or remains deactivated if it was not already activated or has already been deactivated.

The analyses performed show that a revision or adaptation of the HCO is not required in the region of high loads of the gas turbine, in which region the HCO is generally activated, even in the case of load fluctuations. Start-up from a low-load region is also uncritical for the use of the gap minimization. For this purpose, the upper threshold for the operating parameter is defined. In the upper region, above the upper threshold, the gap minimization is therefore activated or remains activated if it was already activated.

In the transition region between the lower threshold and the upper threshold, the correlation between the actual value of the operating parameter and the maximum value of the operating parameter from the immediate past is taken into consideration. In the transition region between the lower and the upper threshold, the HCO function is thereby activated or deactivated in dependence on the behavior of the gas turbine in the predefined time period. For this purpose, the limit value of the operating parameter is required, which is dependent on the maximum value. If the actual value lies above the limit value, that is to say between the limit value and the upper threshold, the gap minimization is or remains activated. If, however, the actual value lies below the limit value, that is to say between the lower threshold and the limit value, the gap optimization is or remains deactivated.

By means of the proposed method, very precise activation of the HCO function takes place, as a result of which multiple HCO activation hours are obtained during operation of the gas turbine, which has a positive effect on the efficiency of the gas turbine. By means of the method, the complexity of the division of the operating regimes of the gas turbine is limited to only three cases, in which the HCO logic controller must decide whether the HCO is activated or deactivated. The above-described HCO logic controller additionally provides better correspondence with the machine behavior and is independent of active gap measurement.

According to an embodiment of the method, there is used as the operating parameter the relative power, which is normalized to the nominal power of the gas turbine. The relative power is coupled directly with the absolute power, which is readily available in the controller of the gas turbine and does not require additional outlay in terms of hardware in order to be detected.

According to a further embodiment, the time period is between 20 minutes and 3 hours, in particular between 30 min and 90 min. The time period is governed by the reaction time of the turbine and is accordingly machine-dependent. The time period is in particular specified in the controller of the gas turbine.

Advantageously, the lower threshold lies at a relative power of between 30% and 45%. This means that the gap minimization is activated only when at least 30% of the nominal power of the gas turbine are reached. Below this relative power, it is provided that the HCO function is permanently inactive.

Further, the upper threshold lies at a relative power of between 50% and 65%. At the latest when 65% of the nominal power of the gas turbine are reached, depending on the case this can also take place at only 50% of the nominal power of the gas turbine, the HCO is activated and remains permanently active above the upper threshold.

After a fall in the relative power which is followed by a rise in the relative power, the gap minimization is advantageously activated with a time delay if the actual value exceeds the limit value. Activating the HCO with a time delay prevents a considerable load difference being avoided by rapid maneuvers. For this reason, a further barrier of the HCO is defined, which blocks HCO activation for a period of from a few minutes to a maximum of 30 minutes.

With a view to particularly simple machine control, multiple stages for the maximum value are defined between the lower threshold and the upper threshold, wherein for the activation or deactivation of the gap minimization, only the highest stage exceeded by the maximum value in the time period is taken into consideration. In this manner, continuous storage of the maximum value at each change of the maximum value is not required. Only when the gas turbine rises into a higher power stage, for example, is it recorded that the gas turbine was operated above that level. Such a procedure constitutes a further simplification in the determination of the limit value, since the maximum value remains constant for a longer time as a result.

Advantageously, the correlation between the limit value and the maximum value is predefined. For practical reasons, the relationship maximum value and the limit value is specified in particular in the form of a table. This is wholly sufficient for the application, and is very reliable and controllable. Accordingly, it is simply necessary to know the maximum value of the operating parameter in order to determine the limit value quickly and without great computational effort. In the case where the transition region is divided into multiple stages, a correlation between the limit value and the maximum value is advantageously predefined for each stage. The respective correlations are recorded in the table.

According to an alternative form, the correlation between the limit value and the maximum value is determined by computation. This takes place in particular according to a formula stored in the controller.

In order to achieve maximum efficiency in operation of the gas turbine with active gap minimization by a maximum temporal utilization of the gap minimization, the method steps from the determination of the actual value of the operating parameter are advantageously carried out continuously during operation of the gas turbine, as soon as the gas turbine is brought into operation.

BRIEF DESCRIPTION OF THE DRAWINGS

An exemplary embodiment of the invention will be described in greater detail with reference to a drawing, in which.

In the figures, the same reference numerals have the same meaning.

DETAILED DESCRIPTION OF INVENTION

Figure 1:
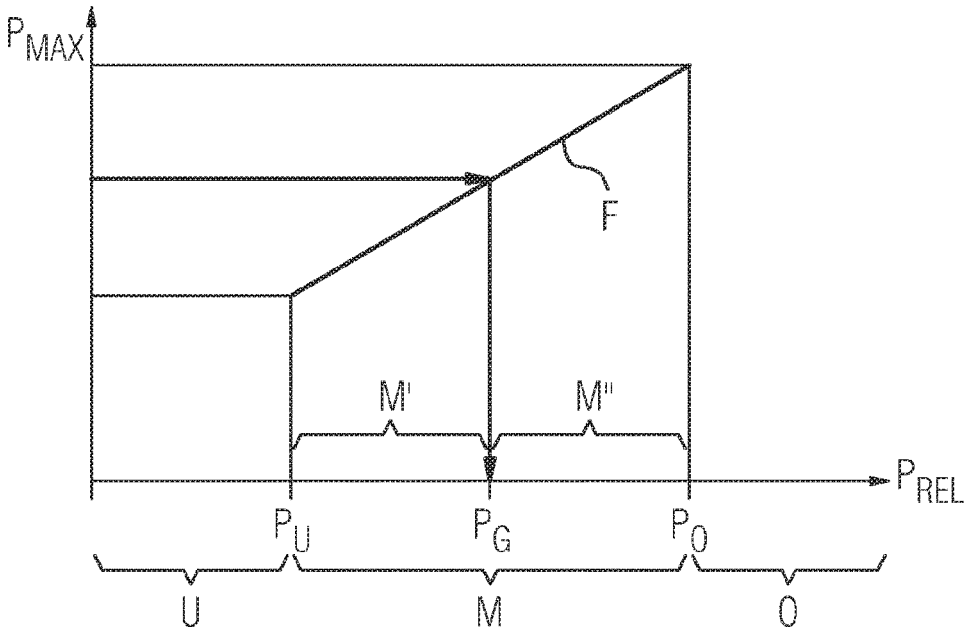
FIG. 1 shows the division of the relative power of a gas turbine into three regions in respect of the HCO activation.

FIG. 1 shows a graphical representation of the three power regions into which the power of a gas turbine, not shown in greater detail, having a gap-adjusting device according to the novel HCO logic controller is divided and which is characterized by different operating regimes. The gap-adjusting device, which in particular is hydraulically driven, is part of a control device, not shown in greater detail here, which communicates by data connections with sensors, likewise not shown, which monitor the operation of the gas turbine. On the X-axis there is plotted the relative power $P_{REL}$, which is formed by the current power, which is normalized by the nominal power of the gas turbine. On the Y-axis there is plotted the maximum value of the relative power $P_{MAX}$ of the gas turbine. The three regions U, M and O on the X-axis are separated from one another by a lower threshold $P_U$ and an upper threshold $P_O$. Between zero and the lower threshold $P_U$, the power region is marked U. Above the upper threshold $P_O$, the power region is marked O. Between the lower threshold $P_U$ and the upper threshold $P_O$ there is the middle transition region M, in which a limit value $P_G$ lies. The thresholds $P_U$ and $P_O$ are machine-specific and are stored in the controller of the gas turbine, which is contained in a control device, not shown. For example, $P_U$=40% and $P_O$=60%. These numerical values may optionally also be changed.

The line F, which extends over the transition region M, shows the dependence of the limit value $P_G$ on the maximum value $P_{MAX}$. In the exemplary embodiment shown, this dependence is stored in a table which the controller is able to access. The table is in turn based on a simulation data set which was generated by means of a simulation program or digital twin for this turbine type.

The decision whether the HCO is activated or deactivated, or remains active or inactive, is based on the evolution of an actual value $P_I$ of the relative power $P_{REL}$. For this purpose, the maximum value $P_{MAX}$ of the actual value $P_I$ (see FIG. 2) is recorded for a time period which, for example, always corresponds to the last hour. The time period is likewise stored in the controller and is machine-specific. The time period can also be shorter than 1 hour (e.g. the measurements of the relative power $P_{REL}$ from the last 45 minutes are used) or also longer (e.g. 90 min).

If the actual value $P_I$ lies in the lower region U beneath the lower threshold $P_U$, the controller deactivates the gap minimization or, if the gap minimization is already inactive, it remains deactivated.

If the actual value $P_I$ lies in the upper region O above the upper threshold $P_O$, the controller activates the gap minimization or, if the gap minimization is already active, it remains activated.

In the transition region M, the gap minimization is activated or deactivated depending on whether the actual value $P_I$ of the relative power $P_{REL}$ is in the region M' below the limit value $P_G$ or in the region M" above the limit value $P_G$. The limit value $P_G$, as already explained, can be derived on the basis of the correlation (F), stored in the controller, from the maximum value $P_{MAX}$ of the maximum power $P_{MAX}$ in the last hour.

In order to simplify the detection of the maximum value $P_{MAX}$, multiple stages for the maximum value $P_{MAX}$ can additionally be defined on the Y-axis, wherein only the highest stage exceeded by the maximum value $P_{MAX}$ in the last hour is taken into consideration for the activation or deactivation of the gap minimization. For example, between 3 and 10 such stages can be defined, which stages can also be of different sizes. In particular, the line F looks slightly different for each stage, that is to say the predefined or calculated correlation between the limit value $P_G$ and the maximum value $P_{MAX}$ can vary from stage to stage.

In addition, a further barrier can be incorporated in the HCO, which blocks HCO activation for 15 min, for example. The barrier takes effect in particular following a considerable load or power rise in the transition region M or in the upper region O which follows a considerable load or power drop in the lower region U.

Figure 2:
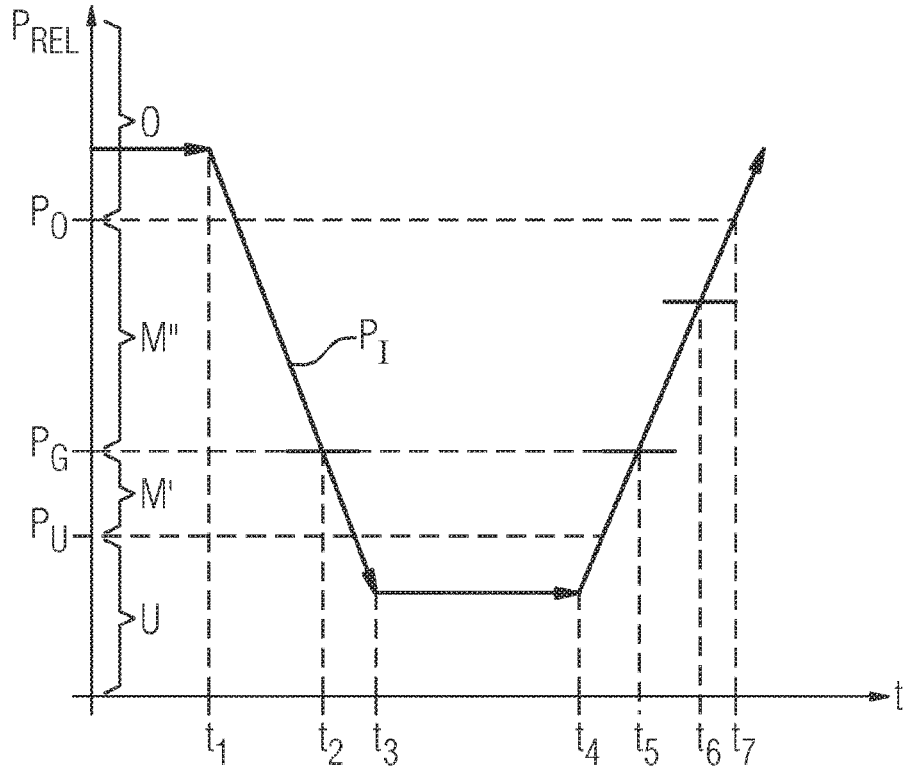
FIG. 2 shows a detail of the course of the relative power of the gas turbine over time.

This case is shown in FIG. 2, in which the relative power $P_{REL}$ is plotted over time t. Up to time $t_1$, the actual value $P_I$ is substantially constant and lies in the upper power region O, in which the HCO is active. Between $t_1$ and $t_3$, $P_I$ falls rapidly until a value below the lower threshold $P_U$ is reached. When the power falls below the limit value $P_G$ in the transition region M at time $t_2$, gap minimization is deactivated. Between $t_3$ and $t_4$, the actual value $P_I$ remains in the lower region U and the HCO thus remains inactive. Between $t_4$ and $t_7$, the $P_I$ increases constantly, wherein at time $t_5$ the limit value $P_G$ is exceeded again. However, this does not trigger activation of the HCO at $t_5$, but gap minimization takes place only after, for example, a further 15 min, at time $t_6$, although the actual value $P_I$ lies in the region M" the entire time. At time $t_7$, the actual value $P_I$ is again at the level of the starting state of the gas turbine according to FIG. 2.

If the actual value $P_I$ were to fall again, for example, after $t_4$ before activation of the HCO, this would under certain circumstances influence $P_{MAX}$ from the last hour, which could in turn lead to a new limit value $P_G$.

The invention claimed is:

1. A method for controlling a gap minimization of an adjustable gap between a rotor and a housing of a gas turbine, wherein the gas turbine comprises a hydraulic gap adjusting device, the method comprising:

with the aid of a simulation program, the operation of the gas turbine with different parameter settings is modeled and a simulation data set is prepared which contains the dependence of the gap size on an operating parameter, on the basis of the simulation data set, a lower threshold (PU) and an upper threshold (PO) for the operating parameter are specified, furthermore, for a transition region (M) between the lower threshold (PU) and the upper threshold (PO), a correlation (F) between the operating parameter and a maximum value (PMAX) of the operating parameter is extracted from the simulation data set, during operation of the gas turbine, an actual value (PI) of the operating parameter is continuously determined and compared with the lower threshold (PU) and the upper threshold (PO), and the maximum value (PMAX) of the actual value (PI) is determined over a specified time period, wherein, in the comparison of the actual value (PI) with the lower threshold (PU) and the upper threshold (PO), if the actual value (PI):

lies below the lower threshold (PU), the gap minimization is deactivated, lies above the upper threshold (PO), the gap minimization is activated, lies in the transition region (M), a limit value (PG) for the operating parameter is determined with the aid of the maximum value (PMAX) from the specified time period using the correlation (F) and the gap minimization is activated if the actual value (PI) lies above the limit value (PG) and deactivated if the actual value (PI) lies below the limit value (PG), wherein there is used as the operating parameter the relative power (PREL), which is normalized to the nominal power of the gas turbine.

2. The method as claimed in claim 1, wherein the time period in which the maximum value (PMAX) is determined is between 20 minutes and 3 hours.

3. The method as claimed in claim 2, wherein the time period in which the maximum value (PMAX) is determined is between 30 minutes and 90 minutes.

4. The method as claimed in claim 1, wherein the lower threshold (PU) lies at a relative power (PREL) between 30% and 45%.

5. The method as claimed in claim 4, wherein the upper threshold (PO) lies at a relative power (PREL) between 50% and 65%.

6. The method as claimed in claim 5, wherein, after a fall in the relative power (PREL) which is followed by a rise in the relative power (PREL), the gap minimization is activated with a time delay if the actual value (PI) exceeds the limit value (PG).

7. The method as claimed in claim 6, wherein multiple stages for the maximum value (PMAX) are defined between the lower threshold (PU) and the upper threshold (PO), wherein only the highest stage exceeded by the maximum value (PMAX) in the time period is taken into consideration for the activation or deactivation of the gap minimization.

8. The method as claimed in claim 1, wherein the correlation between the limit value (PG) and the maximum value (PMAX) is predefined.

9. The method as claimed in claim 7, wherein a correlation between the limit value (PG) and the maximum value (PMAX) is predefined for each stage.

10. The method as claimed in claim 1, wherein the correlation between the limit value (PG) and the maximum value (PMAX) is determined by computation.

11. The method as claimed in claim 1, wherein the method is carried out continuously during operation of the gas turbine.

12. A control device for carrying out the method as claimed in claim 1, comprising: a hydraulic gap-adjusting device, and means for determining the actual value of the operating parameter.

13. A gas turbine, comprising:

a control device as claimed in claim 12.

* * * * *